US009003588B2

(12) United States Patent
Amos et al.

(10) Patent No.: US 9,003,588 B2
(45) Date of Patent: Apr. 14, 2015

(54) APPLIANCES WITH SUDSING-REDUCING FLUSHABLE DETERGENT DISPENSERS

(75) Inventors: Sylvan J. Amos, Kalamazoo, MI (US); Eric G. Griswold, St. Joseph, MI (US); Ryan K. Strain, Coloma, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1048 days.

(21) Appl. No.: 12/905,133

(22) Filed: Oct. 15, 2010

(65) Prior Publication Data

US 2011/0247147 A1 Oct. 13, 2011

Related U.S. Application Data

(60) Provisional application No. 61/323,810, filed on Apr. 13, 2010.

(51) Int. Cl.
*D06F 39/02* (2006.01)

(52) U.S. Cl.
CPC ..... *D06F 39/02* (2013.01); *D06F 39/028* (2013.01)

(58) Field of Classification Search
CPC ..... D06F 39/02; D06F 39/028
USPC ..... 8/158, 159; 68/17 R, 207; 9/158, 159
See application file for complete search history.

(56) References Cited

U.S. PATENT DOCUMENTS

| | | | | |
|---|---|---|---|---|
| 4,759,202 | A | 7/1988 | Caron | |
| 7,313,934 | B2 | 1/2008 | Heo et al. | |
| 2003/0145633 | A1 | 8/2003 | Merkle et al. | |
| 2004/0244434 | A1 | 12/2004 | Zucholl et al. | |
| 2005/0166645 | A1* | 8/2005 | Favret et al. | 68/12.18 |
| 2005/0229652 | A1 | 10/2005 | Kim et al. | |
| 2005/0241072 | A1* | 11/2005 | Kim et al. | 8/158 |
| 2005/0274156 | A1 | 12/2005 | Yang | |
| 2011/0067456 | A1* | 3/2011 | Quandt | 68/12.18 |

FOREIGN PATENT DOCUMENTS

| | | | |
|---|---|---|---|
| CN | 1746408 | A | 3/2006 |
| CN | 101446027 | A | 6/2009 |
| DE | 2038324 | | 2/1972 |
| DE | 3403852 | A1 | 8/1985 |
| DE | 3715832 | A1 | 11/1988 |
| DE | 3736252 | A1 | 5/1989 |
| DE | 3803196 | A1 | 8/1989 |
| DE | 102008004258 | A1 | 10/2008 |
| EP | 0128070 | A1 | 12/1984 |

(Continued)

OTHER PUBLICATIONS

Machine translation of DE 102008004258 A1, no date.*

*Primary Examiner* — Joseph L Perrin

(57) ABSTRACT

Appliances having a detergent dispenser that may be flushed with a water flow for removal of residual treating chemistry while reducing sudsing are disclosed. An example dispenser includes a cup with a bottom wall, a siphon tube projecting upwardly from the bottom wall, a cover for the siphon tube, an opening configured to introduce a liquid stream into the cup from a position above and beyond a periphery of the cover, wherein substantially all of the liquid stream flows downwardly along a trajectory defined by the opening and terminating below and within the periphery of the cover, and wherein the liquid stream directly impinges a portion of at least one of the cup or the siphon tube below the cover.

15 Claims, 5 Drawing Sheets

(56) References Cited

FOREIGN PATENT DOCUMENTS

| | | | | |
|---|---|---|---|---|
| EP | 0211463 | A1 | | 2/1987 |
| EP | 0244900 | A2 | | 11/1987 |
| EP | 0628651 | B1 | | 12/1994 |
| EP | 0884414 | B1 | | 12/1998 |
| EP | 1423564 | B1 | | 6/2004 |
| EP | 1703012 | A2 | * | 9/2006 |
| EP | 1939347 | B1 | | 7/2008 |
| EP | 2025798 | A2 | | 2/2009 |
| FR | 2401259 | | | 3/1979 |
| FR | 2503744 | | | 10/1982 |
| FR | 2590917 | A1 | | 6/1987 |
| FR | 2632984 | A1 | | 12/1989 |
| GB | 1161216 | | | 8/1969 |
| GB | 1265422 | A | * | 3/1972 |
| GB | 1289412 | | | 9/1972 |
| GB | 1330798 | | | 9/1973 |
| GB | 2165267 | A | | 4/1986 |
| GB | 2165555 | A | | 4/1986 |
| GB | 2187763 | A | | 9/1987 |
| GB | 2187764 | A | | 9/1987 |
| GB | 2306303 | A | | 5/1997 |
| JP | 2005253507 | A | * | 9/2005 |
| KR | 20050045258 | A | | 5/2005 |
| KR | 20050047424 | A | | 5/2005 |
| KR | 20100034897 | A | | 4/2010 |
| WO | 2008/128899 | A2 | | 10/2008 |
| WO | 2010/056085 | A2 | | 5/2010 |

* cited by examiner

APPLIANCES WITH SUDSING-REDUCING FLUSHABLE DETERGENT DISPENSERS

CROSS REFERENCE TO RELATED APPLICATIONS

The present application claims the benefit of U.S. Provisional Patent Application No. 61/323,810, filed Apr. 13, 2010, which is incorporated herein by reference in its entirety.

BACKGROUND OF THE INVENTION

Laundry treating appliances, such as clothes washers, clothes dryers, refreshers, and non-aqueous systems, may be provided with a dispenser for automatically dispensing one or more treating chemistries during a cleaning cycle. Such dispensers are well-known devices for receiving powder and/or liquid treating chemistries, such as detergents, bleach, and fabric softeners, and dispensing the treating chemistries into a treating chamber during an operation cycle of the laundry treating appliance. Such dispensers typically have one or more dispensing cups that may be filled with only enough treating chemistry, i.e. a "charge" or "dose", for a single cleaning cycle. The cups are usually designated for only a powder treating chemistry or a liquid treating chemistry. Users have been known to fill the cup with the wrong type of treating chemistry and this may cause problems within the dispenser.

Typically, water is flushed through the cup to dispense the treating chemistry into the treating chamber. The water may not fully remove the treating chemistry from the cup or there may be poor mixing of the treating chemistry and the water. The residual treating chemistry may negatively impact the efficacy of the next treating chemistry placed in the cup or may undesirably alter the dosage of the same treating chemistry in a subsequent dose.

SUMMARY OF THE INVENTION

The invention relates to a fabric treating appliance and a method for treating fabric where a liquid stream is introduced into a dispensing cup from a position above the cup and beyond a periphery of a cover over a siphon tube in the cup, with the liquid stream traveling downwardly along a trajectory terminating below and within the periphery of the cover, wherein the liquid stream directly impinges a portion of at least one of the cup and siphon tube below the cover.

DESCRIPTION OF EMBODIMENTS OF THE INVENTION

Figure 1:
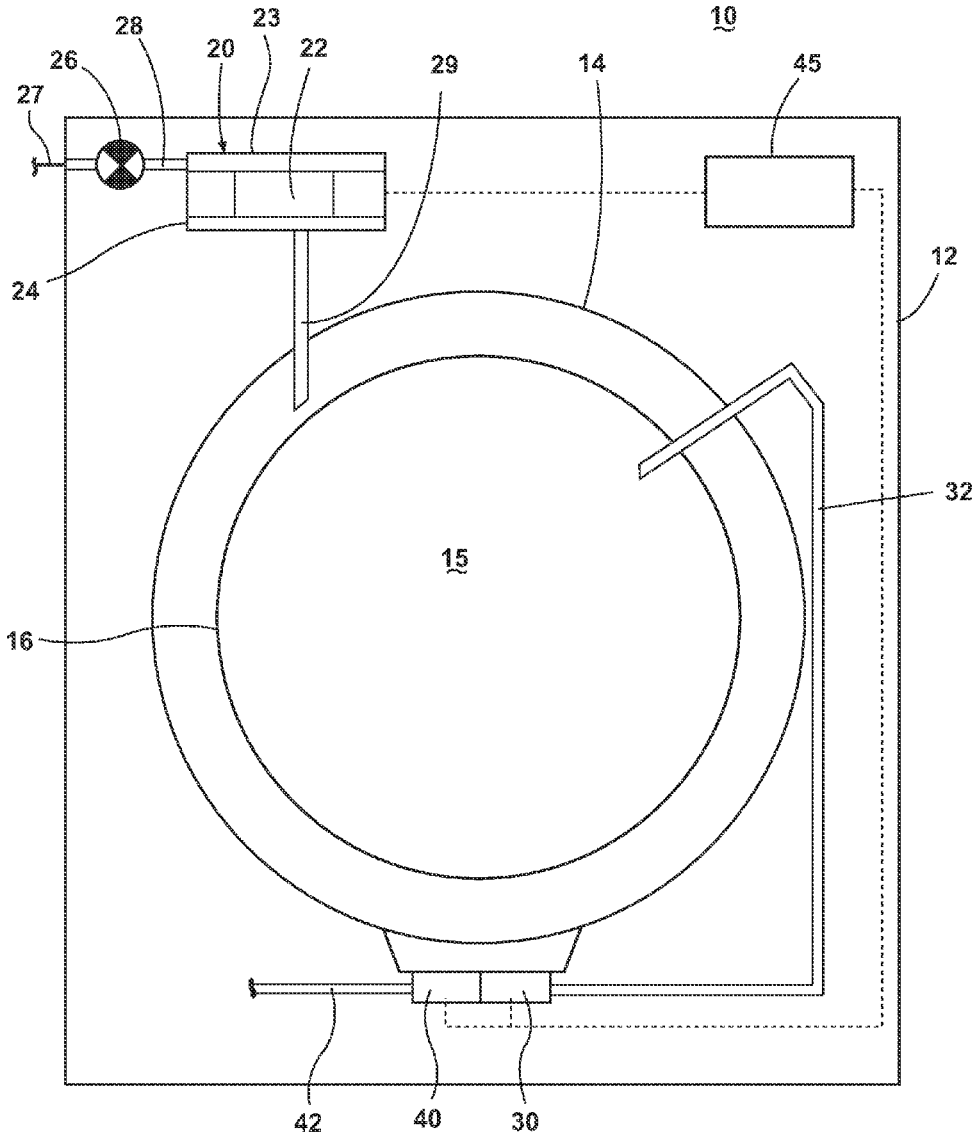
FIG. 1 is a schematic illustration of a fabric treating appliance in the form of a laundry treating appliance according to a first embodiment of the invention.

FIG. 1 schematically illustrates a first embodiment of the invention in the environment of a fabric treating appliance, such as a laundry treating appliance in the form of a clothes washer 10 comprising a housing 12, which may be a cabinet, chassis, or both, defining an interior. As illustrated, the laundry treating appliance is a horizontal axis washing machine; however, the laundry treating appliance may be any appliance which performs a cycle of operation on laundry, non-limiting examples of which include a vertical-axis washing machine; a horizontal or vertical axis clothes dryer; a combination washing machine and clothes dryer; a tumbling or stationary refreshing/revitalizing machine; an extractor; and a revitalizing machine. As used herein, the term "horizontal-axis" washing machine refers to a washing machine having a rotatable drum that rotates about a generally horizontal axis relative to a surface that supports the washing machine. The drum may rotate about the axis inclined relative to the horizontal axis, with fifteen degrees of inclination being one example of the inclination. Similar to the horizontal axis washing machine, the term "vertical-axis" washing machine refers to a washing machine having a rotatable drum that rotates about a generally vertical axis relative to a surface that supports the washing machine. However, the rotational axis need not be perfectly vertical to the surface. The drum may rotate about an axis inclined relative to the vertical axis, with fifteen degrees of inclination being one example of the inclination. The clothes washer 10 described herein shares many features of a traditional automatic washing machine, which will not be described in detail except as necessary for a complete understanding of the invention. Further, it should be understood that the invention may be adapted for use with other appliances, such as dishwashers, employing a dispensing system.

A tub 14 may be provided in the interior of the housing 12 and may be configured to hold liquid. The tub 14 may be supported within the housing 12 by a suitable suspension system (not shown). A drum 16 may be provided within the tub 14 and may define a treating chamber 15 for receiving fabric, such as laundry to be treated according to a cycle of operation. The drum 16 may be mounted for rotation within the tub 14. The drum 14 may have perforations that permit the flow of water between the drum 16 and the tub 14.

The tub 14 and drum 16 may have aligned openings that provide access to the treating chamber 15. A door (not shown) may be provided to selectively close at least one of the aligned openings to selectively provide access to the treating chamber 15.

A dispensing system illustrated as a treating chemistry dispenser 20 may be provided within the housing 12 and may include at least one treating chemistry reservoir 22, a liquid distribution header, such as a water distributor 23, and a dispenser housing 24. One or more treating chemistries may be provided in the treating chemistry reservoir 22 in any desirable configuration, such as a single charge, multiple charge (also known as bulk dispenser), or both. Examples of typical treating chemistries include, without limitation, water, detergent, bleach, fabric softener, and enzymes. The treating chemistry dispensing system 20 may be configured to meter the treating chemistry as required for a particular cycle of operation.

A liquid such as water may be supplied from a water source, such as a household water supply 27, to the treating chemistry dispensing system 20 by operation of a valve 26 controlling the flow of water through a conduit 28. An outlet conduit 29 extends from the treating chemistry dispensing system 20 to the tub 14. Thus, any treating chemistry supplied from the treating chemistry dispensing system 20 may be supplied to the tub 14 via the outlet conduit 29.

A liquid recirculation system may be provided for recirculating liquid to the treating chamber 15. As illustrated, the recirculation system includes a recirculation pump 30 and a spray conduit 32. The recirculation pump 30 fluidly couples the tub 14 to the spray conduit such that liquid in the tub 14 may be supplied to the spray conduit 32, where it may be sprayed into the treating chamber 15. The recirculation pump 30 may be located in a low portion or sump of the tub 14.

A liquid drain system may be provided for draining liquid from the treating chamber 15. The liquid draining system may include a drain pump 40 and a drain conduit 42. The drain pump 40 fluidly couples the tub 14 to the drain conduit 42 such that liquid in the tub 14 may be drained via the drain conduit 42. The drain conduit 42 may be coupled to a household drain. The drain pump 40 may be located in a low portion or sump of the tub 14.

A controller 45 may be provided for controlling the operation of the various components of the laundry treating appliance 10 to implement one or more cycles of operation, which may be stored in a memory of the controller 45. Examples, without limitation, of cycles of operation include: wash, heavy duty wash, delicate wash, quick wash, refresh, rinse only, and timed wash. Any suitable controller 45 may be used. The specific type of controller is not germane to the invention. It is contemplated that the controller 45 may be a microprocessor-based controller that implements control software and sends/receives one or more electrical signals to/from each of the various components to affect the control software. As an example, proportional control (P), proportional integral control (PI), and proportional derivative control (PD), or a combination thereof, a proportional integral derivative control (PID control), may be used to control the various components. The controller 45 may be operably coupled to at least the water supply valve 26, the dispensing system 20, the recirculation pump 30, the drain pump 40, and a motor (not shown) that rotates the drum 16 to control the operation of these and other components to implement one or more of the cycles of operation.

Figure 2:
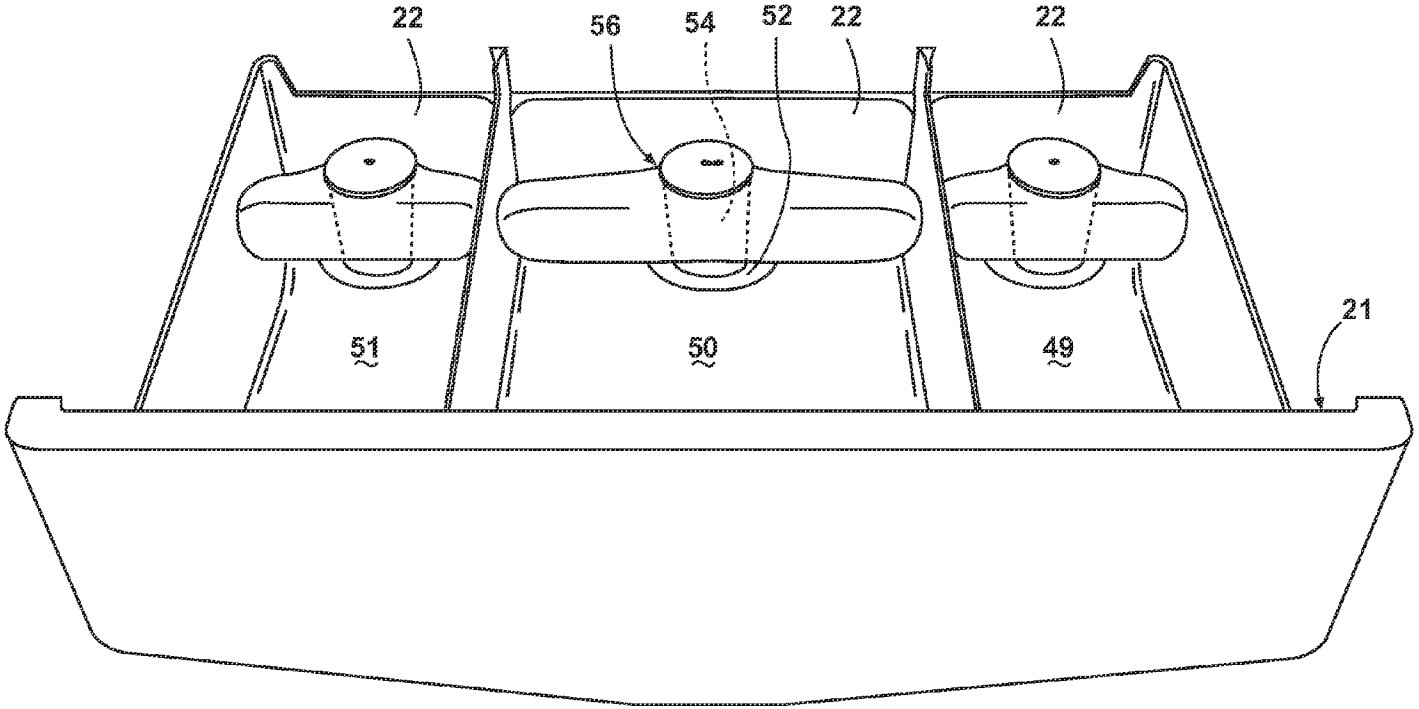
FIG. 2 is a perspective view of the dispenser drawer of the laundry treating appliance of FIG. 1.

Looking at the treating chemistry dispensing system 20 in greater detail, it may be provided on an exterior or interior of the housing 12 and may be immediately accessible by the user or hidden behind a cover, such as a drawer 21 or an access panel as illustrated in FIG. 2. Further, the treating chemistry dispensing system 20 may include multiple treating chemistry reservoirs 22, which are supplied a liquid stream such as water from the water distributor 23 to flush the contents from the reservoirs into the tub. These multiple treating chemistry reservoirs define cups 49, 50, and 51. Each cup 49, 50, 51 includes a siphon tube 54 (shown partially in phantom) that extends above and below the bottom wall of each cup 49, 50, 51 and the longitudinal axis defined by the siphon tube 54 is generally perpendicular to a vertical axis and the bottom wall of each cup 49, 50, 51. The siphon tube 54 may be surrounded by a siphon sump 52 formed in the bottom wall of each cup 49, 50, 51. The portion of the siphon tube 54 extending above the bottom and into the cup 49, 50, 51 may be received within a siphon cover 56. The siphon cover 56 may include a sleeve with a periphery that covers additional portions of the siphon tube 54. The siphon tube 54 forms a siphon device for removal of the treating chemistry solution from each cup 49, 50, 51 during operation of the treating chemistry dispensing system 20. The siphon tube 54 may be fluidly coupled to the dispenser housing 24 and the treating chamber 15 such that the treating chemistry solution may be dispensed to the treating chamber 15.

Figure 3:
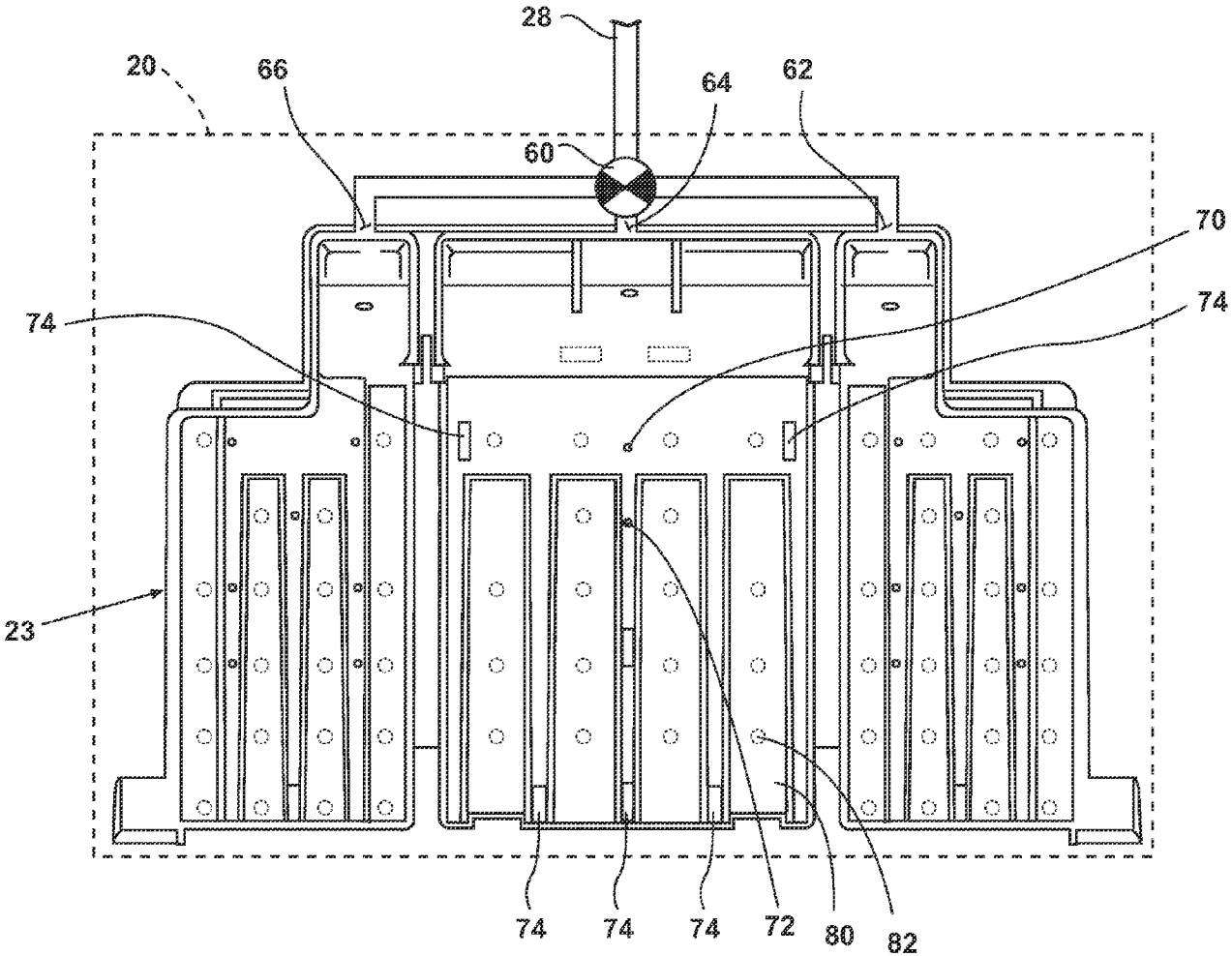
FIG. 3 is a top view of a liquid distribution header functioning as a water distributor for the laundry treating appliance of FIG. 1.

FIG. 3 illustrates that the water distributor 23 may include multiple water inlets 62, 64, and 66, water outlet holes 70 and 72, water outlet slots 74, and raised portions 80 and raised nibs 82. Each of the water inlets 62, 64, and 66 may correspond to a separate portion of the water distributor 23 which in turn distributes water to each of the cups 49, 50, and 51 respectively. The water inlets 62, 64, and 66 are fluidly coupled to the conduit 28 through a valve 26 which may selectively distribute water to each of the cups 49, 50, and 51 by selectively controlling the flow of water through the water inlets 62, 64, and 66. More specifically, when water is introduced through water inlet 64 it may travel through water outlet holes 70 and 72 and water outlet slots 74 to cup 50. The raised portions 80 and raised nibs 82 help to channel the flow of water from the water inlet 64 to the liquid stream outlet holes 70 and 72 and water outlet slots 74.

Figure 4:
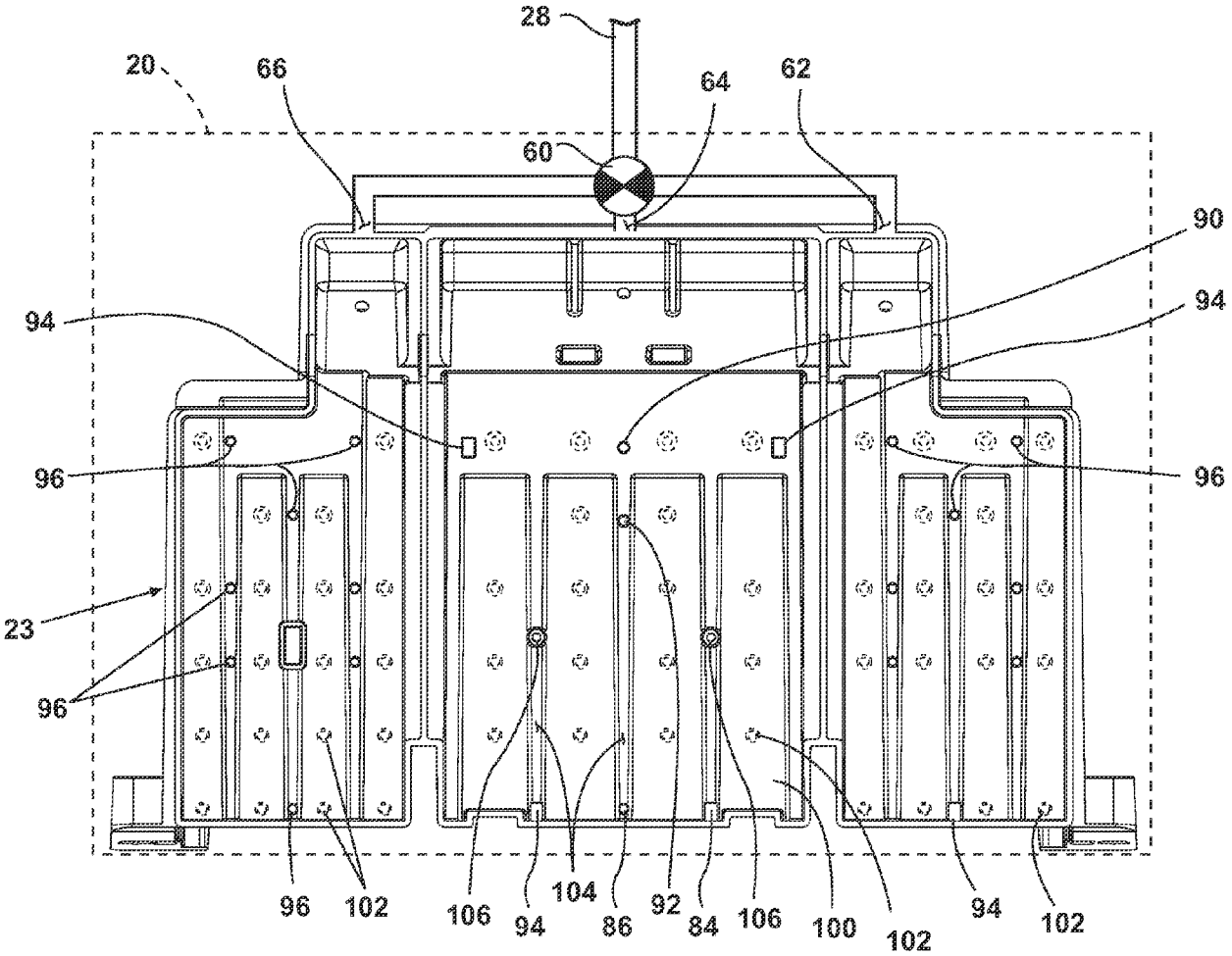
FIG. 4 is a top view of another example of a liquid distribution header of the fabric treating appliance of FIG. 1.

FIG. 4 illustrates another example of the liquid distribution header with a different configuration of holes and slots than the water distributor of FIG. 3. The water distributor 23 may include multiple water inlets 62, 64, and 66, water outlet holes 86, 90, 92, and 96, water outlet slots 94, raised outlet holes 106, raised portions 100, and raised nibs 102. The water distributor 23 shown here may include shorter water outlet slots 94 compared to the water outlet slots 74 of the distributor of FIG. 3. The raised outlet holes 106, by providing a barrier around the hole, may provide for a different flow of the water there through compared to the holes 90, 92, and 96. The flow through the raised outlet holes 106 may be less than the flow through the holes 90, 92, and 96.

Each of the water inlets 62, 64, and 66 may correspond to a separate portion of the water distributor 23 which in turn distributes water to each of the cups 49, 50, and 51 respectively. Water inlets 62, 64, and 66 are fluidly coupled to the conduit 28 through a valve 26 which may selectively distribute the water to each of the cups 49, 50, and 51 by selectively controlling the flow of the water through the water inlets 62, 64, and 66. When water is introduced through water inlet 64 it may travel through water outlet holes 86, 90, 92, and 96 and water outlet slots 94 to cups 49, 50, and 51. The raised portions 100, raised nibs 102, and the walls of the raised outlet holes 106 help to channel the flow of water from the water inlet 64 to the water outlet holes 86, 90, 92, 96, the hole of the raised outlet hole 106, and water outlet slots 94.

Although treating chemistries, in either liquid or powder form, may be provided in any desirable configuration, the remainder of this application will describe only a single charge of treating chemistry. Thus, the at least one treating chemistry reservoir 22 stores a single dose of treating chemistry that the treating chemistry dispensing system 20 may dispense to the tub 14, as part of the execution of the cleaning cycle; i.e., typically the entire volume of chemistry contained within the at least one treating chemistry reservoir 22 is dispensed into the tub 14 during a single cleaning cycle.

Figure 5:
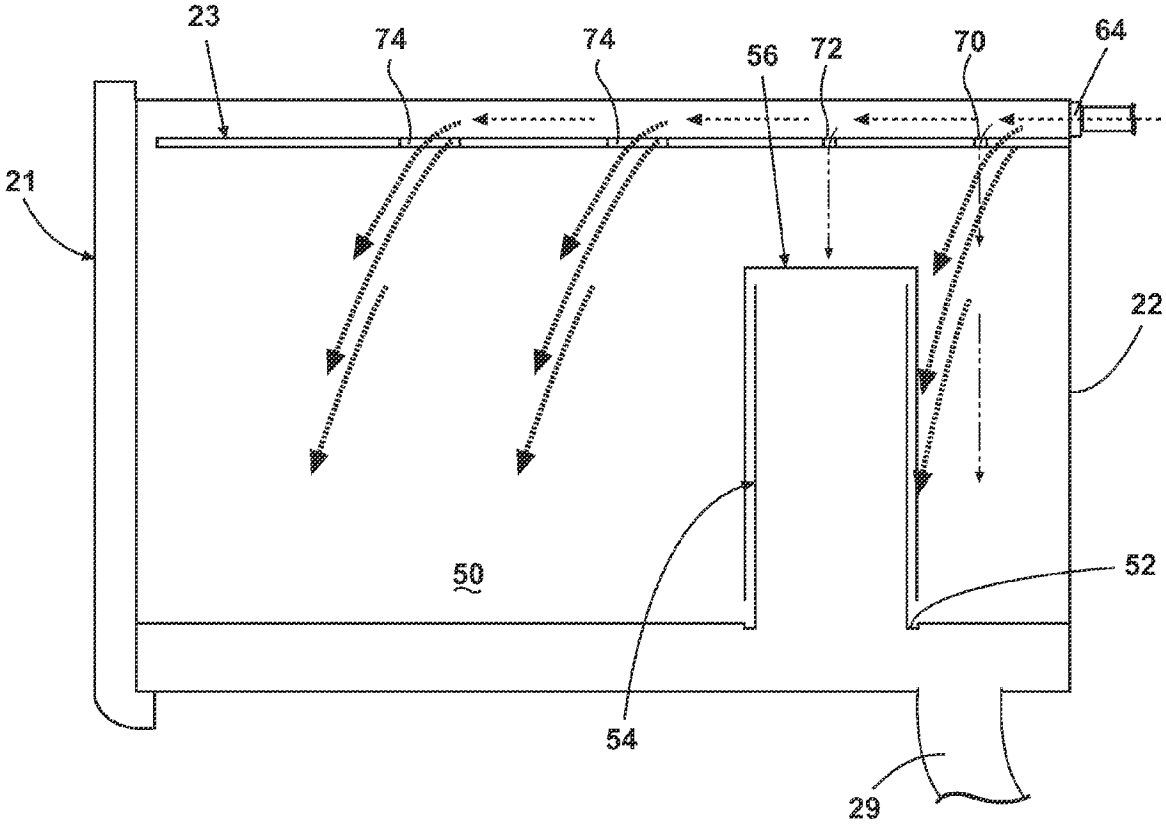
FIG. 5 is a schematic illustration of a portion of the dispenser drawer and a portion of the water distributor of the laundry treating appliance of FIG. 1.

FIG. 5 illustrates the operation of either one of the water distributor 23 described in conjunction with FIGS. 3 and 4. Water may flow through the water inlet 64 and into the water distributor 23. The water may then flow through the water outlet holes 70, 72, 86, 90, and 92 and water outlet slots 74 and 94 to cup 50. The small diameter of the water outlet holes 70, 72, 86, 90, and 92 creates a stream of water with a small flow and a high velocity. The water outlet holes 70 and 90 may be positioned such that the water flowing from them impinges on and keeps the siphon sump 52 and portions of the cup adjacent the siphon tube 54 clean of any debris. The water outlet holes 72 and 92 may be positioned such that the water flowing from impinges upon and keeps the top of the siphon cover 56 clean of any debris.

The larger area of the water outlet slots 74 and 94, as compared to the water outlet holes 70, 72, 86, 90, and 92 provides for a greater flow of water to enter the cup 50 under a slightly lower velocity and in more of a shower or spray pattern, as compared to the discrete jet produced by the water outlet holes 70, 72, 86, 90, and 92 and the raised outlet holes 106. The shape of the water outlet slots 74 and 94 also provide for the water to spray in a forward direction instead of straight down as with the water outlet holes 70, 72, 86, 90, and 92. The forward velocity of the spray may provide for greater turbulence and mixing when the water contacts the detergent contained in each of the cups 49, 50, and 51 without creating excess sudsing. This shower spray pattern and the forward spray direction of the spray coming from the water outlet slots 74 and 94 on either side of the water outlet hole 70 and 90 function to keep the area under the siphon cover 56 clean because the water from the water outlet slots 74 and 94 contacts the bottom of the cups 49, 50, and 51 and spreads out and cleans the bottom of the cups 49, 50, and 51. The shower like spray and its forward directional spray also provides for the spray to pass under and not be blocked by the siphon cover 56. Thus, the shower like spray may be able to spray both the siphon tube 54 and any sleeve that the siphon cover 56 may have. In other words, the liquid stream outlet holes 70 and 72 and liquid stream outlet slots 74 are two outlet openings that introduce two different liquid streams downwardly into the cups 49, 50, and 51 from a position above the siphon cover 56 and along a generally vertical trajectory. The liquid stream may be either a continuous stream or a discontinuous stream.

The water outlet slots 74 and 94 also provide the additional functionality of limiting the amount of suds produced by the incoming water that is sprayed into each of the cups 49, 50, and 51 by limiting the velocity of the water as compared to the jets of water from the water outlet holes 70, 72, 86, 90, and 92. The higher velocity of the water entering the cups tends to increase the amount of suds. Thus, the lower velocity of the water from the water outlet slots 74 and 94 reduces the amount of suds that would be present if holes were used instead of the slots. The additional suds may create cross flow into the outer cups.

The treating chemistry dispensing system 20 is especially advantageous when any of the cups 49, 50, and 51 contains a powder detergent. Powder tends to solidify in cooler temperatures, such as a cold water wash, and it tends to stick to the bottom of the cups 49, 50, and 51 when the cups 49, 50, and 51 contain residual water from a previous cycle. When using a siphon tube 54, there will be residual water in the cups 49, 50, and 51 due to the water held vertically between the siphon cover 56 and the siphon tube 54. A high velocity shower is one way to remove the residual or dried powder, but it tends to generate more suds than desired. The water outlet slots 74 and 94 have a larger surface area than typical outlet holes which results in a lower velocity shower than the spray from the holes, but a spray that still has a high enough velocity to remove the residual powder while providing reduced aeration, by having a portion of its spray velocity in a direction parallel to the bottom of the cups 49, 50, and 51 and thereby creating fewer suds.

It should be noted that in chemistry dispensing system 20, the treating chemistry reservoir 22 can be used with either liquid or powder detergent dispensed through a siphon tube 54 into the treating chamber 15. The siphon tube 54 is fluidly coupled to the outlet conduit 29. Although the use of a siphon tube 54 can result in residual liquid from a previous cycle as described above, the siphon tube 54 also allows the benefit of the powder detergent time to more uniformly mix with the liquid stream delivered via the water distributor 23 before the mixture proceeds to the outlet conduit and into the treating chamber 15.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of operating an appliance comprising a treating chamber, and a treating chemistry dispenser having a cup and a siphon, where the siphon includes a siphon tube and a cover having a periphery, and where the siphon is fluidly coupled to the treating chamber, the method comprising:

introducing a shower of liquid into the cup through a slot positioned above and beyond the periphery of the cover so the shower of liquid that strikes the cover along substantially a length of the cover.

2. The method of claim 1, wherein the shower of liquid comprises a discontinuous cascade.

3. The method of claim 1, wherein the shower of liquid further strikes a portion of the cup adjacent the siphon tube.

4. The method of claim 1, wherein the shower of liquid further strikes a junction of the siphon tube and the cup.

5. The method of claim 1, wherein the shower of liquid washes away residual treating chemistry beneath the cover.

6. The method of claim 1, further comprising introducing a liquid stream into the cup through an opening, wherein substantially all of the liquid stream flows along an axis generally parallel to a longitudinal axis of the siphon.

7. The method of claim 6, wherein the opening is located above the cover.

8. The method of claim 6, wherein both the shower of liquid and the liquid stream are emitted from a distribution header positioned above the cup.

9. The method of claim 6, wherein the opening has a shape different from the slot.

10. The method of claim 9, wherein the shape comprises a hole.

11. The method of claim 1, further comprising introducing a liquid stream into the cup from a position above the cover, wherein substantially all the liquid stream flows downwardly along a generally vertical trajectory.

12. The method of claim 1, wherein the slot is defined by at least a first dimension and a second dimension different from the first dimension.

13. The method of claim 1, wherein a portion of the shower of liquid further strikes the siphon tube beneath the cover.

14. The method of claim 1, wherein a portion of the shower of liquid further strikes the cup beneath the cover.

15. The method of claim 1, wherein a trajectory of the shower of liquid is generally along a plane defined at least in part by a longitudinal axis of the slot and a generally vertical axis.

* * * * *